United States Patent [19]

Zaniewski

[11] Patent Number: 4,759,272

[45] Date of Patent: Jul. 26, 1988

[54] VENTILATOR

[76] Inventor: Michel Zaniewski, L'Arceliere 70, Av. F. deLesseps, Frontignan, France, 34110

[21] Appl. No.: 870,256

[22] Filed: Jun. 3, 1986

[30] Foreign Application Priority Data

Jun. 3, 1985 [FR] France ..... 85 08697

[51] Int. Cl.[4] ..... F23L 17/02

[52] U.S. Cl. ..... 98/42.05; 98/42.06; 98/119; 98/78; 110/162; 416/185

[58] Field of Search ..... 98/42.05, 42.06, 42.1, 98/42.12, 78, 79, 84, 116, 119; 110/162; 416/185

[56] References Cited

U.S. PATENT DOCUMENTS

| | | | |
|---|---|---|---|
| 116,049 | 6/1871 | Gouge | 98/42.05 |
| 891,967 | 6/1908 | Wiemann | 98/119 |
| 1,011,259 | 12/1911 | Smith et al. | 416/185 |
| 1,575,144 | 3/1926 | Bishop | 98/119 |
| 1,623,286 | 4/1927 | Strahan | 98/119 X |
| 2,106,040 | 1/1938 | Schmidt | 416/185 |
| 2,561,135 | 7/1951 | Resek | 110/162 |
| 2,617,371 | 11/1952 | Resek | 110/162 |
| 4,342,258 | 8/1982 | Zaniewski | 98/78 |

FOREIGN PATENT DOCUMENTS

| | | | |
|---|---|---|---|
| 1095316 | 2/1981 | Canada | 98/42.06 |
| 1246321 | 10/1960 | France | 110/162 |
| 152187 | 4/1932 | Switzerland | 98/42.05 |
| 705949 | 3/1954 | United Kingdom | 98/42.05 |

*Primary Examiner*—Harold Joyce

*Attorney, Agent, or Firm*—Pennie & Edmonds

[57] ABSTRACT

A ventilator comprising a rotating plate provided on its lower surface with blades forming a centrifugal turbine surmounting the mouth of a ventilation duct or ducts in whose axis said turbine creates an ascending vortex effect. The aspiration to which the main duct or ducts are subjected is obtained by the rotation of a turbine (4a) comprising a flange (4) and a plurality of blades (10) fastened to lower surface of flange (4). The blades have a trough shape facing away from the direction of rotation of the turbine, the blades having an inner edge that makes an angle of less than 90 degrees with the flange.

21 Claims, 5 Drawing Sheets

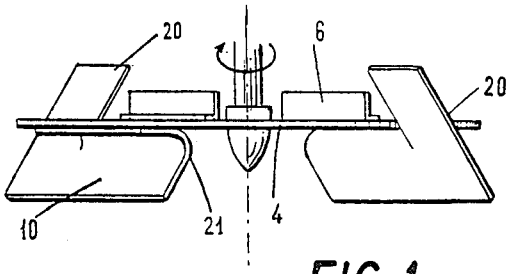
FIG. 1
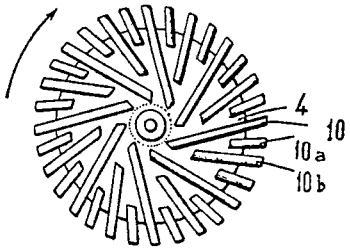
FIG. 2a
Fig. 2b
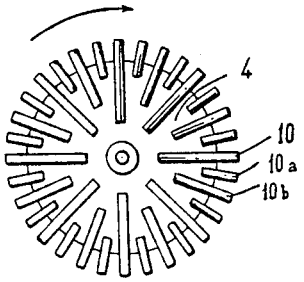
FIG. 2b
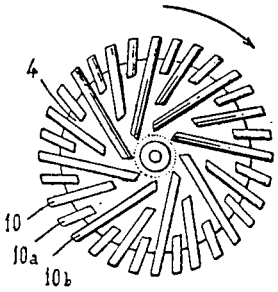
FIG. 2a

VENTILATOR

BACKGROUND OF THE INVENTION

This relates to a ventilator and, more particularly, to one that is normally mounted at the end of a conduit to enhance flow out of the conduit.

It is known to provide ventilators at the upper ends of conduits in order to enhance the vertical flow through them.

The simplest type of such a ventilator is a so-called static ventilator which is so constituted as to employ normally present air currents to enhance the draft from the upwardly open conduit mouth. This can most simply be done by mounting a flat plate above the upper mouth of the conduit so that as air passes horizontally between the plate and the conduit mouth gases are sucked from the conduit by the Pitot effect.

Dynamic ventilators are known, such as described in my U.S. Pat No. 4,200,035. These arrangements have a fan provided at the upper end of the conduit mouth and serving physically to suck air out of the conduit. Such arrangements are extremely effective, yet have the disadvantage that the air rising out of the conduit passes over the blades of the fan and normally also over the drive motor for the fan, thereby heating it considerably.

My U.S. Pat. No. 4,342,258, which is incorporated herein by reference, describes an improved device for the ventilation of rooms and the draft of chimneys. In such device, a disk is mounted above the open end of the duct and an impeller and motor are mounted above the disk so as to create a descending vertical air current to embrace the draft from the duct. Static ventilation is provided by the effect of the low pressure created in the ventilation duct or chimney by an air current that envelopes a toroidal bulb placed at the mouth of the duct. Dynamic ventilation is provided by the descending vertical air current. This arrangement has the additional advantage that the descending vertical air current cools the motor, thus protecting it from heating that would have harmed its service life.

SUMMARY OF THE INVENTION

Further study of the device of the '258 patent has led to a finding that the aspiration thus obtained on the inside of the duct is due not only to the venturi effect caused by the tangential projection of the air current on the outside wall of the bulb parallel to its axis but also, and to a considerable extent, by the whirling of air caused by the rotating impeller on the inside of the ventilation duct or chimney draft. Such whirling has been found to create along the axis of the duct an ascending vortex effect which contributes, in great part, to the desired aspiration effect.

The present invention therefore has as its object, apparatus for increasing this whirling phenomenon by maintaining the outside venturi effect, without neglecting the static suction effect due to the passage of the wind at the end of the ventilation duct or chimney.

This improvement is obtained by modifying the shape of the blades which constitute the ventilation turbine and by replacing the impeller previously used with a centrifugal upper turbine which works with the main ventilation turbine to cool the motor that drives it.

Investigation also revealed that the whirling effect makes itself felt mainly on the axis of the duct at whose summit it was mounted. Accordingly, it is possible, by using concentric ventilation flues to obtain different aspirations in a central flue and in a peripheral flue. Further, it was found that in the central flue, subjected to the greatest whirling effect, the aspiration could be varied according to the position of the upper opening of said flue in relation to the plane of rotation of the turbine, the aspiration increasing as this distance diminishes. At the same time, in the peripheral flue, subjected less to this vortex effect, the aspiration that prevails there is practically independent, within certain limits, of this distance and also independent, also within certain limits, of the speed of rotation of the turbine.

This makes it possible to provide a ventilation unit using the blades of the invention that has a plurality of aspirations that are different and adjustable independently of one another in several ventilation ducts. In turn, the ducts can be simultaneously connected to various rooms where they assure a ventilation corresponding to the different needs of each of them. For example, ventilation in each of a group of rooms may be regulated by a program which can comprise different parameters such as time parameters as well as other parameters such as humidity and temperature or it can be regulated manually but independently for each room.

This offers a particular advantage for the ventilation of dwelling or industrial rooms whose exits are provided with modern fluid-tight systems and whose ventilation therefore can be obtained only through ventilation flues provided for this purpose. In certain cases these flues each lead to a dedicated mechanical ventilation element which causes the necessary aspiration for each of these rooms so that there are as many mechanical ventilation elements as there are rooms to ventilate. Moreover, it is very difficult to interconnect each of these flues so as to modulate the ventilation of each room as a function of the ventilation necessary in the other rooms.

In other prior art systems, a single dynamic ventilation unit is used to simultaneously ventilate all rooms; and the amount of ventilation in any room is controlled by a cover over the duct that leads from the rooms. Such installations are expected to function 24 hours a day. They have the drawbacks that they do not have any static ventilation means and they are susceptible to fouling of their turbine by suction of vapors loaded with grease.

The present invention makes it possible to avoid these drawbacks. The turbine which creates the vortex effect which makes possible the obtaining of various levels of aspiration in the various associated flues also works with static aspiration elements so it is possible to use the wind for some ventilation needs. As a result, power requirements for ventilation can be divided between electric power and natural energy.

BRIEF DESCRIPTION OF DRAWING

The accompanying drawings, given only by way of example, show the embodiment of the object of the invention and some of its applications.

FIG. 1 is a diagrammatic view in perspective of two open blades making up a part of the turbine in accordance with the invention.

FIGS. 2*a*, 2*b* and 2*c* are diagrammatic plan views, seen from above, of a centrifugal turbine carrying the blades of the present invention organized in various ways to create the desired whirling effect.

DETAILED DESCRIPTION OF PREFERRED EMBODIMENTS OF INVENTION

Figure 3:
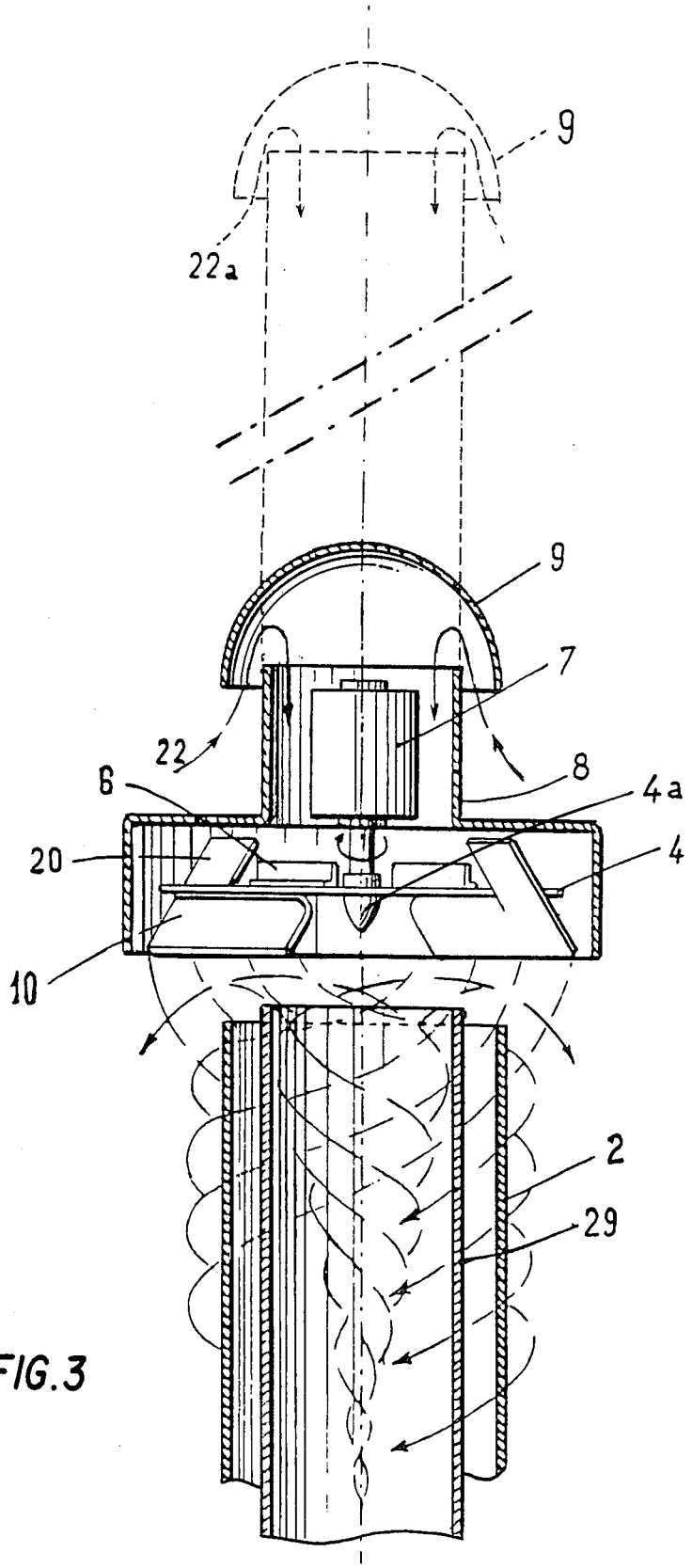
FIG. 3 is a diagrammatic view in diametral vertical section schematizing reciprocal movements of the driving and driven gases.

As shown in FIGS. 1, *2a*, *2b*, *2c*, the device of the present invention comprises an open centrifugal turbine formed by flange 4 which on its lower face supports several series of open trough-shaped blades, such as 10, 10*a* and 10*b*. As shown in FIG. 1, the open trough faces away from the direction of rotation of the blade. In the direction of rotation of the turbine, the blades have a convex face. The position of the blades in relation to radii of flange 4 which carries them depends essentially on the desired aspiration ratio. If the blades are arranged in a perfectly radial array as shown in FIG. *2b*, then for the same number of revolutions of the turbine and the same direction of rotation given by the arrow, the turbine of FIG. *2b* achieves an aspiration less than that obtained by turbine blades in the position of FIG. *2a* but greater than that obtained by turbine blades in the position of FIG. *2c*. As is evident, in FIG. *2a*, the convex face of each blade (as it projects beyond the periphery of flange 4) forms an obtuse angle with the tangent to flange 4; and in FIG. *2c*, the convex face of each blade forms an acute angle with the tangent of flange 4.

The length of each blade, taken in each of series 10, 10*a* and 10*b* for example, is such that they overlap one another according to the drawing of FIGS. *2a*, *2b* and *2c*. Furthermore, as shown in FIG. 1, in which two diametrically opposite blades are shown, the profile of the blade that produces the best output in the sense of the desired aspiration (i.e., the profile that creates the most intense downstream whirling movement at the level of the upper opening of the duct equipped with the system) is a hyperbola portion 21 which exhibits an asymptotic angle, less than 90°, open downstream in the direction of rotation of the turbine. One of the planes of development of said asymptotic angle is solid with flange 4 and the other plane 10 of the asymptote extends downward at the lower part of flange 4 of the turbine. The blade also extends above the upper surface of said flange at the same angle of inclination to form an inclined upper blade 20 extending inward of the outer periphery of the flange. Further, the turbine includes upper blades 6 mounted on the upper surface of flange 4.

Figure 4:
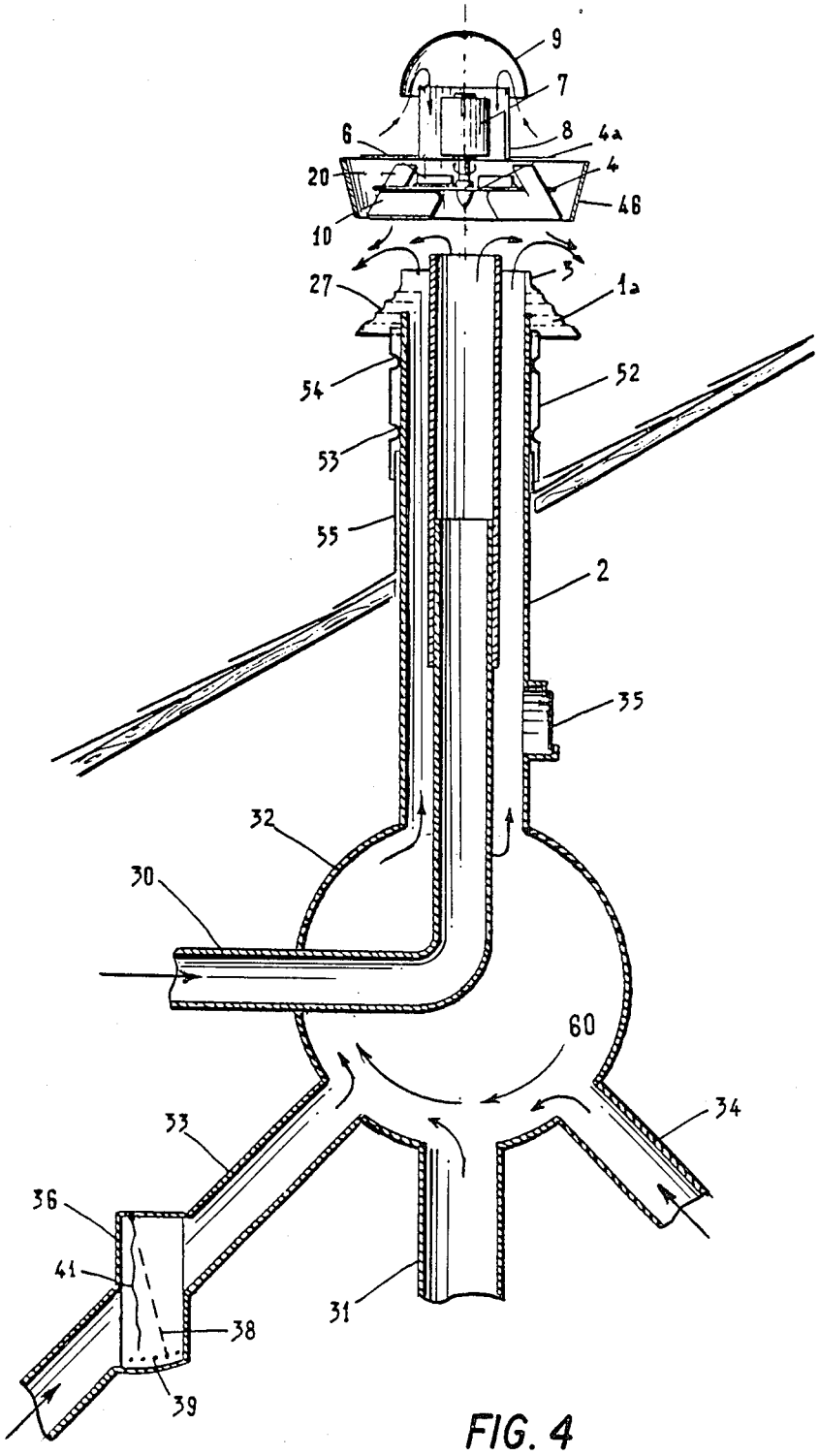
FIG. 4 is a diagrammatic view in vertical diametral section of an adaptation that was made of such a device for ventilating rooms whose driving elements are placed on the roof.

As shown in FIGS. 3 and 4, a turbine 4*a* having blades shaped in accordance with the invention is mounted at the lower opening of a tunnel 8. The turbine is driven in the direction shown by the arrow by a motor 7 mounted within tunnel 8 and covered by a housing 9. The turbine is mounted on a duct 2 whose distal end is surrounded by a cowl 1*a* having a tapered element formed by horizontal curvilinear steps 27. Advantageously, cowl 1*a* is made of cement, which allows its rapid fastening, without special tools, to the top of any ventilation duct or smoke pipe made of masonry materials by the simple interposition of a mortar binder.

When the turbine turns in the direction of the convex face of the blades and a centrifugal turbine is created by upper blades 6 contained in the same housing at the base of tunnel 8, it is found that the upstream flow sucked by said upper turbine is organized, thanks to lower turbine 4*a*, into an intense peripheral whirling current. This current envelops the upper end of duct 2 on which said device is placed, creating on the inside of the latter and along its axis an aspirating, ascending vortex.

This vortex induced on the inside of duct 2 by the outside whirling flow generated by turbine 4*a* is the result of the combined effects of upper blades 6, flange 4 and turbine 4*a*. Upper blades 6 create an upstream flow oriented toward the base of tunnel 8 parallel to its axis and to the periphery of the duct. A screen formed by flange 4 and turbine 4*a* impresses on this upstream flow at the output of tunnel 8 a whirling effect always oriented downward, parallel to the axis of the apparatus and enveloping duct 2 to the point of creating the desired vortex effect in its center.

It is noted that the result obtained depends essentially on the distance that separates turbine 4*a* from the upper mouth of lower duct 2, so that the length of tunnel 8 (shown as dots in FIG. 3) can be any size. With the exception of pressure drops, the extension of tunnel 8 above turbine 4*a* can be enough to assure a constant aspiration of fresh fluid in the direction of arrow 22 at the lower periphery of dome 9 which covers the device, even when the apparatus is used for evacuation of fluid at high temperature. The aerodynamic effects of the device are shown by FIG. 3, in which turbine 4*a*, equipped with such blades, is seen to cause at the upper output of duct 2 a peripheral whirling effect which envelops duct 2 and which induces on the inside of duct 2, on its axis, an ascending, aspirating vortex effect easily shown during smoke projection tests.

Experience shows that on the inside of duct 2 an aspiration is attained which is even greater than the aspiration necessary for the functioning of a combustion heating apparatus, which makes it possible to use such a device for the main ventilation of rooms. And it is found that the aspiration thus obtained on the inside of duct 2 varies as a function of the distance between mouth of duct 2 and turbine 4*a*. Indeed, such a device makes possible the placement of two concentric ducts 2 and 29 (FIG. 3). The aspiration in each of them can then be varied by the simple effect of the movement of sleeve 30 (FIG. 4) which slides on central duct 29, which makes it possible to assure different ventilation deliveries in ducts 2 and 29, independently of their section.

Such a vortex effect thus obtained at the upper mouth of a simple cylindrical tube is added to the venturi effect established due to the presence of the descending vertical air current. This descending air current forms a tangent external to toroidal cowl 1*a*. The parallel curvilinear steps 27 which form the outside wall of the tapered cowl 1*a* assure the deflection of the air streams that surround it when it is subjected to the natural winds whose direction is not horizontal. As a result, it is possible to obtain, at the upper mouth of the cowl, a practically constant venturi effect for winds whose direction deviates about 30° on both sides of the horizontal.

Figure 6:
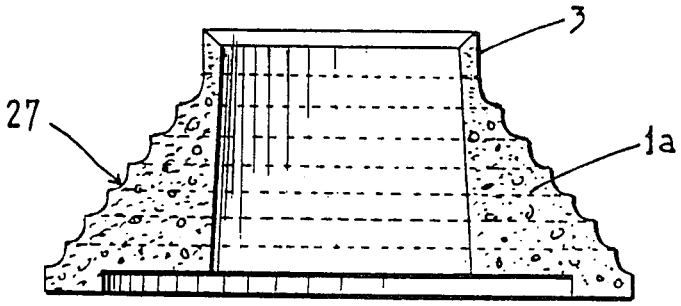
FIG. 6 is a diagrammatic view in vertical diametral section of a chimney cowl which works with the turbine to create the desired aspiration both under the effect of outside winds and of the air current created by the turbine.

The venturi effect thus produced at the upper mouth of cowl 1*a* is also increased by the presence at that level of cylinder portion 3 which at its upper part 3*a* exhibits an outside sharp edge as shown in FIG. 6. This edge can also consist of a metal ring inserted in mortar used to make said cowl 1*a*. Alternatively, the cowl could be made entirely of metal.

It should also be noted that upper extension 20 of the blades of turbine 4*a* assures the cooling of motor 7 by aspiration of the outside air through tunnel 8 along arrows 22, creating around motor 7 an air current which then participates in the whirling effect generated by turbine 4*a*.

The device being thus constituted, it is found that the aspiration obtained in concentric ducts 2 and 29 is such that the delivery of air that it causes makes it possible simultaneously to assure the ventilation of several rooms and the extraction of the fumes from a heating installation. The possibility of thus constituting a suction unit is further facilitated by the possibility that has just been described of causing the variation of the aspiration obtained in each of the ducts by the simple positioning of their mouth in relation to main turbine 4*a*.

As shown in FIG. 4, the suction unit comprising turbine 4*a* and motor 7 may be mounted on concentric vertical ducts 2 and 29 on the outside of the roof of a building. Illustratively, central duct 29 is connected by duct 30 directly to the room which is supposed to benefit from the greatest ventilation delivery, the kitchen, for example. The heating installation for which the aspiration should be less than that in duct 29 to avoid excess draft is connected by flue 31 with peripheral duct 2. The mouth of duct 2 is located at a level lower than that of duct 29 in relation to turbine 4*a*, which subjects it to a lower aspiration.

Peripheral duct 2 can come out in generally spherical hollow element 32 on the wall diametrically opposite from which heating duct 31 simultaneously comes as well as ducts 33 and 34 which illustratively are connected with bathrooms for which the ventilation requirements are less than those of the kitchen.

It is then found that the whirling effect created on the inside of duct 2 extends to the inside of spherical chamber 32 and facilitates the driving of the flue gases and stale air reciprocally of said ducts 31, 33 and 34 in the direction shown by arrow 60 (FIG. 4).

The device is completed by a regulator 35 of known type installed on duct 2 to keep the winds that sweep cowl 26 from creating an excess aspiration, especially in duct 31 for evacuation of flue gases.

Figure 7:
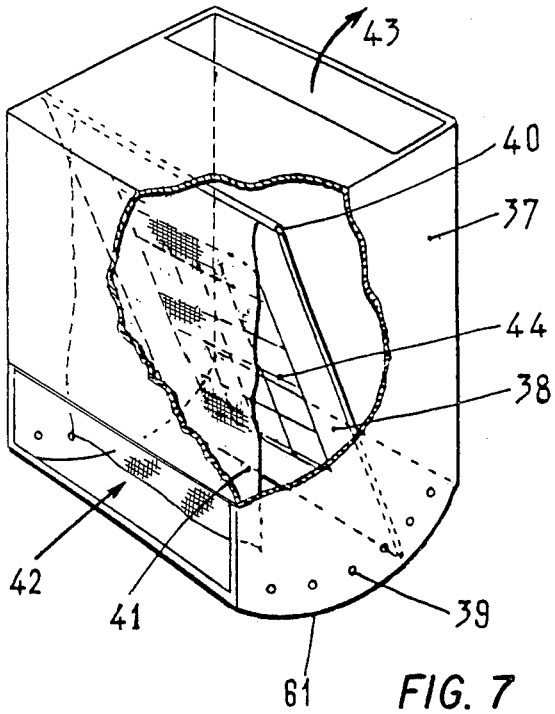
FIG. 7 is a cutaway perspective diagrammatic view of the control valve intended to control the air sucked into the various ducts according to the needs of the rooms served by said ducts.
Figure 8:
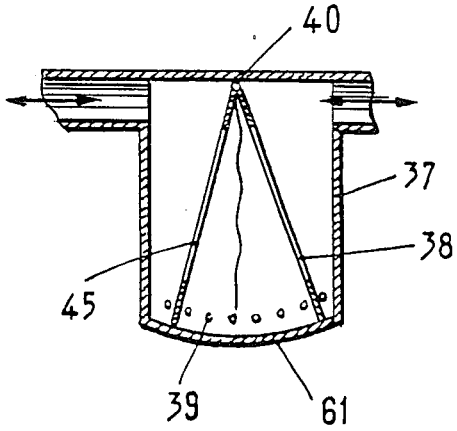
FIG. 8 is a diagrammatic view in median vertical section of said control device according to a double-action variant.

Further, each of secondary ducts 33 and 34 is provided in its path with a special regulator 36, shown in more detail in FIGS. 7 and 8. Said regulator constitutes a box 37 of a general parallelepiped shape on the inside of which a frame 38 can move by rotation around a horizontal axis 40. The base of said frame extends to the base of circular sector 61, and the entire periphery of frame 38 is sufficiently fluid-tight with respect to the inside of box 37 as to assure the passage of the air solely through an opening 44 in the inside of frame 38. The frame is held in a predetermined position by notches 39. A flexible sheet 40 of fabric, for example, is suspended from the same height as axis 40. The surface of the sheet is less than the total surface of frame 38 but greater than the empty space of this same frame.

When such a device is inserted in a suction pipe so that the air travels through it in the direction indicated by arrows 42 and 43, for a certain aspiration flexible sheet 41 will be aspirated and will flatten against frame 38 against which it will be held by central grill 44 thus blocking the passage at this level. For a lower aspiration, however, sheet 41 will allow the air to pass freely around its periphery and through the opening in frame 41. The pressure at which air passage is cut off can be varied depending on the inclination given to frame 38 held by notches 39.

Moreover, as shown in FIG. 8, such a device can be used with double action. For this, box 37 is provided on the inside with two frames 38 and 45 hinged around the same upper horizontal axis 40 and between which flexible sheet 41 is suspended. Such an arrangement makes it possible, as just said, to regulate, by the position of frame 38, the aspiration created by the ventilation unit. At the same time the device of FIG. 8 makes it possible, by regulation of the position of second frame 45 to prevent siphoning. Siphoning could occur wherever, because of the orientation of the rooms served, the natural aspiration created externally by the winds that envelop it would come to be greater than the aspiration maintained by the mechanical or static elements of the ventilation unit.

The organization, according to FIG. 4, of the set of mechanical elements of the ventilation unit above the roof requires that they be made of stainless materials, which is expensive. Accordingly, it may be desirable to install them under the roof, according to FIG. 5, with only the static elements remaining outside. This makes it possible to reduce the cost of the unit.

Figure 5:
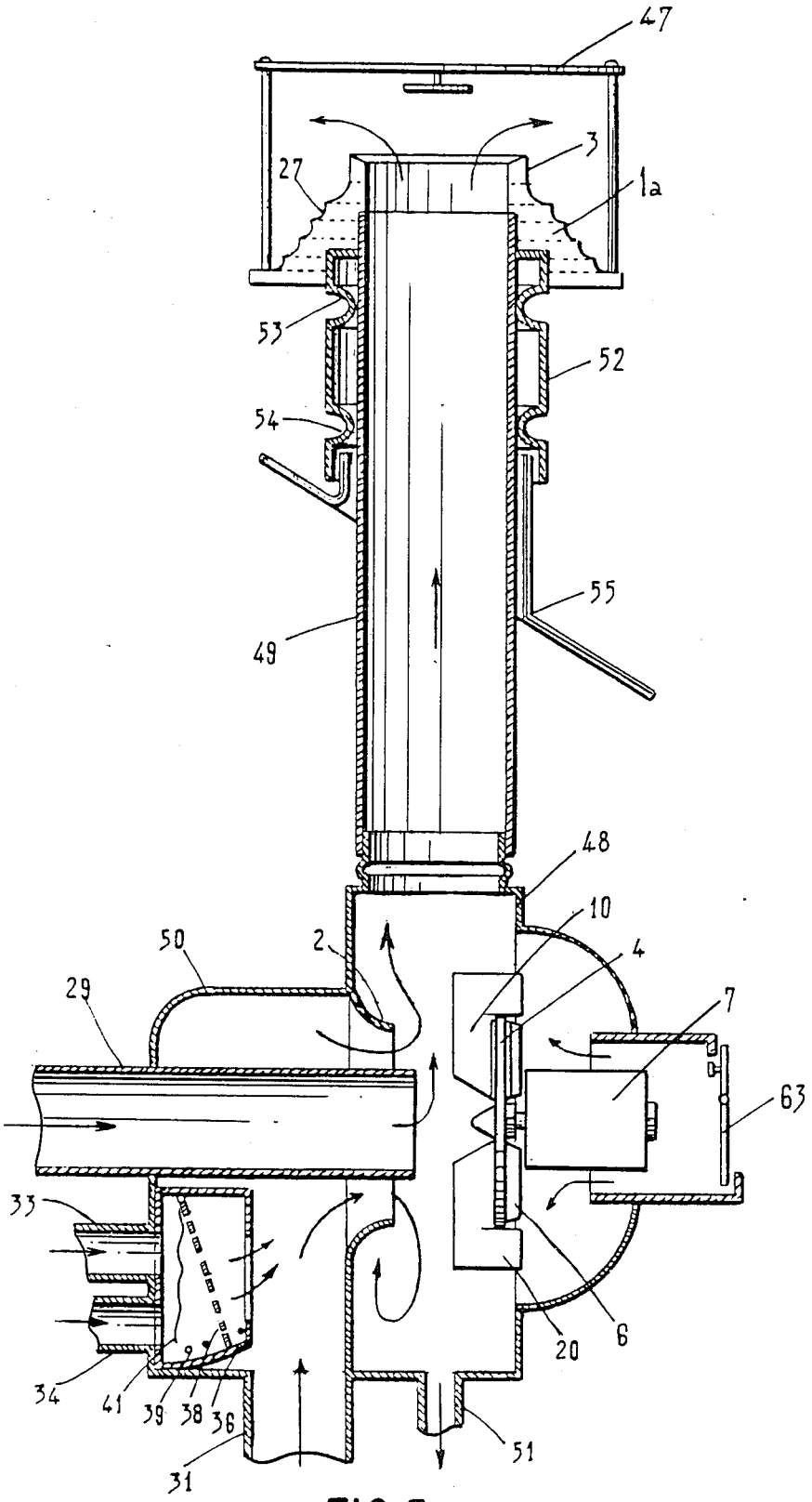
FIG. 5 is a diagrammatic view in vertical diametral section of a variant that was made of such a device to locate the mechanical elements on the inside of the rooms.

As shown in FIG. 5, only discharge duct 49 comes out of the roof where it is covered by cowl 1*a* which works with known static elements 47. Its lower part is connected to the open mouth of volute 48, which here plays the role of chamber 32, and on the inside of which there is put into rotation turbine 4*a* on whose axis concentric duct 29 of peripheral opening 2 is aligned.

Motor 7 located in tunnel 8 receives outside fresh air aspirated by dorsal turbine 6. And regulator 63, placed at the entry of tunnel 8, prevent excess draft which could be due to the combination of the aspiration created by the static elements with that generated by the dynamic elements of the system.

Chamber 50, whose suction opening is constituted by opening 2, is subjected to the aspiration that prevails at that point as a result of the same whirling effect previously described. This chamber assures the distribution of the aspiration at the level of ducts 33 and 34 through common regulator 36, which convey the stale or humid air from the bathrooms, and the aspiration applied at the level of duct 31 which conveys the flue gases from heating of the apartment.

In one or the other of the two variants represented by FIGS. 4 and 5, the ventilation is obtained most of the time by means of only the static elements of the system, constituted by tapered cowl 1*a* working with collar 46 of FIG. 4 or with plate 47 provided with a lower deflector of FIG. 5.

If desired, the device can be provided with a contact hygrostat. Since the possible absence of wind can be reflected by an increase in the degree of moisture in the evacuation duct, this can be sensed by the hygrostat and used to trigger the automatic start of the turbine to increase ventilation. Starting of the turbine can also be obtained by means of a manual switch operated during the hours a room is used, and also by a timer which assures an operating program of the ventilation unit.

Further, since the speed of the turbine can vary under the effect of a manual control or under the effect of an automatic control operated by a hygrostat placed in duct 29 which serves a particular room, the ventilation of this room can be increased either manually or automatically during the service hours of this room. The aspiration, however, need not be increased in the flues serving other rooms both as a result of the presence of regulator 36 which controls flues 33 and 34, or even flue 31 for evacuation of the flue gases and as a result of the relative stability of the aspiration at the entry of peripheral mouth 2 which is practically independent of the speed of rotation of the turbine.

Moreover, the variant represented in FIG. 5 offers the advantage, thanks to the rotation of turbine (4*a*) on the inside of volute 48, of allowing centrifuging of the grease vapors carried by the stale air coming through duct 29 or the heating fumes that come through pipe 31. Such vapors and fumes can condense on the walls of volute 48 and flow naturally through a tube 51 provided for this purpose at the base of the volute. Tube 51, in turn, is connected to a drain (not shown) toward which the pressure prevailing in volute 48 pushes them.

It is further noted that this centrifuging and condensation of grease vapors are performed on the inside of volute 48 so that the sections for passage of stale air and flue gases cannot be constricted by their fouling. As a result, even if turbine 4*a* is stopped for an extended time as a result of an electric power failure, the natural heat draft will still continue to function through general evacuation duct 49. Thus, at no time can there be any forcing back of the flue gases in the ducts serving the bathrooms even if such units are organized in different apartments of the same building or connected to the same general evacuation duct.

The invention therefore makes it possible to prevent asphyxia accidents recorded during the use of known ventilation units which use a squirrel cage type turbine freely open to the atmosphere, without addition of the upper draft static element and through which the evacuated grease vapors pass. Actually, in such installations the blades of the turbine in the form of a squirrel cage rapidly become fouled by the condensation of greases at their level, so that in the case of interruption of the electric power these same fouled turbines oppose the natural draft of the general main of the building to which each individual heating system is connected. This causes the spread in the upper floors of the flue gases coming from the lower floors. These installations are therefore obliged to operate continuously, requiring a considerable expenditure of energy. Since the dynamic draft thus obtained is never relieved by a static draft, there is a danger in case of a breakdown.

The device thus constituted is completed at the level of its passage through the roof by a fluid-tight collar 52 of appropriate length which facilitates the laying and assures a perfect seal at this level. As shown in FIGS. 4 and 5, the collar is aligned on duct 2 or 59 by circular knurls 53 and 54. Knurls 54 rest on collar 55 whose base participates in the cover elements of the roof. At the upper end of collar 52, knurls 53 support cowl 1*a* also assuring the necessary fluid tightness at this level.

Such a unit can therefore be effectively used to constitute a unit for ventilation of all the rooms of the same apartment including the fume duct, thus replacing in an economical way the multiple ventilation and draft elements which are now used and whose operation is expensive because generally constant. The centralized system of the present invention makes it possible to assure ventilation of each room proportional to its own variable needs depending on its daily use cycle and using electric power only to the extent that the energy of the winds at such time is not sufficient to create the desired ventilation or heat draft by means of the static elements which the device also has.

Further, thanks to the efficiency of the cooling of motor 7 which drives turbine 4*a* and which is never in contact with the hot gases, no deterioration of the mechanical or electrical elements is to be feared even if they are high-temperature gases that are extracted by this means.

Figure 9:
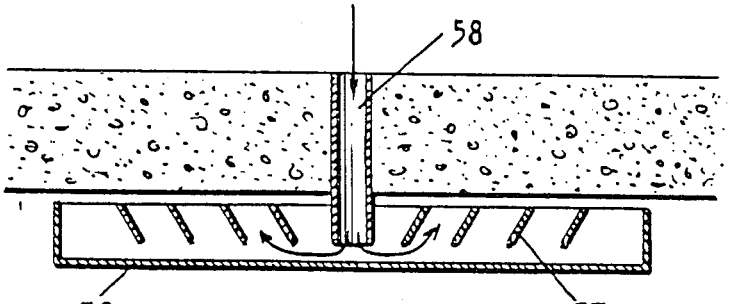
FIG. 9 is a plan diagrammatic view of a device assuring the efficient ventilation of the upper edges of humid rooms.

This ventilation unit can be completed in regard to accessories by deflector 56 (FIG. 9) placed on the inside of the ventilated rooms, close to the upper edges in the points where an unfavorable heat bridge causes additions of moisture. Said deflector 56, constituted by an open gutter on the wall side and provided with diffusions fins 57 receives the air coming from outside the building, under the effect of the forced ventilation created on the inside of the latter by the ventilation unit, through perforation 58 made for this purpose in the wall of the room.

The invention is not limited to the example or examples which have been described, and numerous alternatives will be apparent to those skilled in the art from the foregoing description.

Thus upper blades 6 can occupy a more or less inclined position in relation to the flange that carries them, depending on the desired delivery of the flow for cooling motor 7.

The invention can be used to meet in an economical way the VMC (Controlled mechanical ventilation) standards which must operate 24 hours a day. The invention makes it possible to achieve a substantial savings by its possibility of alternately using the winds thanks to its static elements or the simple heat draft as well as its dynamic elements to create the necessary aspiration. It also makes possible a better automatic distribution of the aspiration obtained between the various ventilated rooms thanks to regulators introduced in the circuits which at the suitable time automatically isolate certain rooms to the benefit of other rooms.

Thus, it is possible to establish an economical balance of the system by allocating a period of about 10 hours per day to purely free static operation, 7 hours to dynamic operation controlled by a hygrostat or a timer, and 7 hours during which only the most exposed rooms are the object of maximum delivery ventilation under the control of hygrostatic probes or manual contacts. For example, during mealtime, putting the kitchen under the effect of a timer causes the automatic closing of the bathrooms by a set of automatic regulators 36, thus reducing the energy consumed to the sole energy necessary for the kitchen. After a set time, ventilation at the average level of the group of rooms can automatically resume.

What is claimed:

1. A ventilator for use in combination with a conduit having an upwardly open mouth of predetermined shape and flow cross section, said ventilator comprising:

a horizontal deflector disk suspended above said mouth, said disk having an outer periphery extending outwardly beyond said mouth and defining with said mouth an annular gap having a flow cross section greater than that of said mouth, a drive motor fixed above said disk for rotating said disk about an upright axis, a plurality of blades mounted on a upper surface of said disk and extending inwardly of the outer periphery of said disk, a plurality of trough-shaped blades mounted on a lower surface of said disk, said blades having an inner edge that makes an angle of less than 90 degrees with said disk, and, a sleeve surrounding said disk and centered on said axis, said blades generating an air stream that moves downwardly through said sleeve, around said periphery of said disk and across said gap for inducing air flow over said body and thereby creating a low-pressure zone at said mouth.

2. The device according to claim 1 wherein the ventilator is mounted on a plurality of concentric ducts and an innermost duct is adjustable in height by means of a mobile sleeve to regulate its proximity in relation to the trough-shaped blades to regulate the aspiration that the latter creates inside said duct.

3. The device according to claim 1 further comprising a generally toroidal annular flow body surrounding said conduit immediately below said mouth and having outer wall having a lower portion space outwardly from said conduit and an outwardly concave and curved upper portion extending upward and inward from said lower portion to said conduit and merging with said conduit substantially at said mouth.

4. The device according to claim 1 wherein the trough-shaped blades face away from the direction of rotation of the blades.

5. The device according to claim 1 wherein the trough-shaped blades extend beyond the outer periphery of said disk.

6. A ventilator comprising a rotating plate provided on its lower surface with blades forming a centrifugal turbine surmounting the mouth of a ventilation duct or ducts in whose axis said turbine creates an ascending vortex effect, characterized in that a forced aspiration to which the main duct of ducts are subjected is obtained by the rotation of a turbine (4*a*) comprising a plurality of blades (10) fastened to a lower surface of said plate (4), said blades having a trough shape facing away from the direction of rotation of the turbine and an inner edge that makes an angle of less than 90 degrees with said plate.

7. The device according to claim 6 wherein blades (10, 10*a*, and 10*b*) of different length are interleaved with one another on the lower surface of plate (4).

8. The device according to claim 7 wherein each of the blades (10, 10*a*, and 10*b*) is radially organized on plate (4) which carries them.

9. The device according to claim 7 wherein an upper surface of plate (4) carries blades (6) which extend inwardly from a periphery of the plate.

10. The device according to claim 9 wherein a motor (7) which drives said turbine (4*a*) is placed in a tunnel (8) that extends to said turbine and through which air passes to cool said motor, aspirated by the blades (6) on the upper surface of the plate (4).

11. The device according to claim 6 wherein the ventilator is mounted on a plurality of concentric ducts, an innermost duct is adjustable in height by means of a mobile. sleeve (30) to regulate its proximity in relation to turbine (4*a*) to regulate the aspiration that the latter creates inside said duct.

12. The device according to claim 6 wherein the upper end of the main duct is covered by a tapered cowl (1*a*) whose outside surface exhibits a succession of curvilinear steps (27), its upper edge, which corresponds to its small base, being at the end of cylindrical neck (3) whose outside edge at least is a sharp edge.

13. The device of claim 6 wherein a main duct (2), on the inside of which is applied the aspiration due to the vortex effect induced by the rotation of turbine (4*a*), is connected at its lower part to a spherical chamber (32) to which are also connected secondary ducts (31), (33) and (34) which provide for the draft of a heating element and ventilation of secondary rooms such as bathrooms.

14. A device according to claim 13 further comprising an aspiration regulator (36) mounted in a secondary duct, said regulator comprising a box (37), on the inside of which is mounted a frame (38) on a horizontal axis (40), said frame (38) occupying the entire section of said box and being movable on the inside of the latter from a vertical position to various inclined positions, said frame providing a fluid-tight seal at its periphery with the walls of the box but permitting fluid flow through a center portion of said frame, and a flexible fabric sheet (41) suspended near said frame (38) and movable toward said frame by aspiration in said duct to cover said center portion of said frame, said box being connected on both sides of said frame to one of the secondary ducts (33) or (34) by openings (42) and (43).

15. A device according to claim 14 wherein aspiration regulator (36) comprises on the inside of box (38) a double frame (38) and (45) each provided with a central portion and both rotatable about horizontal upper axis (40), and a single fabric sheet (41), being suspended between the two frames (38) and (45).

16. A device according to claim 6 wherein a main duct (49), which carries at its upper part a cowl (1*a*) is connected at its lower part with a volute (48) on the inside of which is located said turbine (4*a*) whose motor (7) is ventilated through an opening provided with a regulator (63), a main aspiration opening of said volute (48) being connected through a duct (2) to a chamber (50) which itself is connected directly to a fume duct (31) and through a regulator (36) to ducts (33) and (34) for ventilation of bathrooms, a duct (29) which assures the greatest ventilation, being located in the center of duct (2) and coming out in the vicinity of turbine (4*a*) at a distance from it that is adjustable depending on the desired aspiration; volute (48) moreover then being provided at its base with a duct (51) allowing the evacuation of greases condensed on the wall of said volute under the effect of centrifuging of stale gases by turbine (4*a*).

17. A device according to claim 6 further comprising a gutter-shaped deflector (56) provided with diffusion fins (57), mounted flat against an outside wall of the room to be ventilated at the level of an opening (58) made in said wall and going through it to cause the penetration of the outside air which deflector (56) directs toward the upper edge of the room in the vicinity of which said opening (58) is made.

18. The device according to claim 6 wherein each of the blades in organized on plate (4) so that the extension of the trough shape beyond a periphery of the plate forms an acute angle with a tangent to the periphery of the plate which carries it.

19. The device according to claim 6 wherein each of the blades is organized on plate (4) so that the extension of the trough shape beyond a periphery of the plate forms an obtuse angle with a tangent to the periphery of the plate which carries it.

20. A ventilator for use in combination with a conduit having an upwardly open mouth of predetermined shape and flow cross section, said ventilator comprising:

a horizontal deflector disk suspended above said mouth, said disk having an outer periphery extending outwardly beyond said mouth and defining with said mouth an annular gap having a flow cross section greater than that of said mouth, a drive motor fixed above said disk for rotating said disk about an upright axis, a plurality of blades mounted on an upper surface of said disk and extending inwardly of the outer periphery of said disk, a plurality of trough-shaped blades mounted on a lower surface of said disk, said blades having an inner edge that makes an angle of less than 90 degrees with said flange, a sleeve surrounding said disk and centered on said axis, said blades generating an air stream that moves downwardly around said periphery of said disk and across said gap for inducing air flow over said body and thereby creating a low-pressure zone at said mouth, and means for adjusting the distance between the open mouth of the conduit and the trough-shaped blades to regulate the aspiration that the latter creates inside said conduit.

21. A ventilator comprising:

a rotating plate, a plurality of blades mounted on a lower surface of said plate, forming a centrifugal turbine surmounting the mouth of a ventilation duct of ducts in whose axis said turbine creates an ascending vortex effect, said blades having a trough shape facing away from the direction of rotation of the turbine and an inner edge that makes an angle of less than 90 degrees with said plate, and means for adjusting the distance between the open mouth of the conduit and the trough-shaped blades to regulate the aspiration that the latter creates inside said conduit.

* * * * *